United States Patent [19]

Moen

[11] Patent Number: 4,804,104

[45] Date of Patent: Feb. 14, 1989

[54] SYSTEM FOR FORMING AN OPENING IN A CONTAINER END MEMBER

[75] Inventor: Bruce A. Moen, Golden, Colo.

[73] Assignee: Adolph Coors Company, Golden, Colo.

[21] Appl. No.: 168,428

[22] Filed: Mar. 15, 1988

Related U.S. Application Data

[63] Continuation-in-part of Ser. No. 45,369, May 1, 1987, Pat. No. 4,733,793.

[51] Int. Cl.[4] ..... B65D 17/34

[52] U.S. Cl. ..... 220/269; 220/270

[58] Field of Search ..... 220/269–273

[56] References Cited

U.S. PATENT DOCUMENTS

| | | | |
|---|---|---|---|
| 3,437,227 | 4/1969 | Peyser . | |
| 3,561,631 | 2/1971 | Hatfield et al. . | |
| 3,618,816 | 11/1971 | Brown . | |
| 3,884,382 | 5/1975 | Ball . | |
| 3,967,749 | 7/1976 | Walter . | |
| 4,407,424 | 10/1983 | Heyn . | |
| 4,408,697 | 10/1983 | Yoshikawa et al. . | |
| 4,416,576 | 11/1983 | Kawamata . | |
| 4,491,236 | 1/1985 | Kawamata | 220/269 |
| 4,501,375 | 2/1985 | Katsura et al. . | |
| 4,674,649 | 6/1987 | Pavely | 220/271 |

*Primary Examiner*—George T. Hall

*Attorney, Agent, or Firm*—Klaas & Law

[57] ABSTRACT

A container end member provided with a score line groove defining a severable tab portion that can be severed by applying an inwardly directed force thereto and a hinge portion for retaining the severable tab portion attached to the container end member and a one-piece integrally formed plastic member pivotally secured to the container end member and comprising an elongated body portion having an abutment end portion overlying a portion of the severable tab portion for applying the axially inwardly directed force thereto and a transverse handle end portion overlying another portion of the container end member so that when an axially outwardly directed force is applied to the transverse handle end portion, the elongated body portion will pivot relative to the container end member so that the transverse abutment end portion will apply the axially inwardly directed force to the portion of the severable tab portion to sever the severable tab portion along the score line groove and form an outlet opening in the container end member.

16 Claims, 5 Drawing Sheets

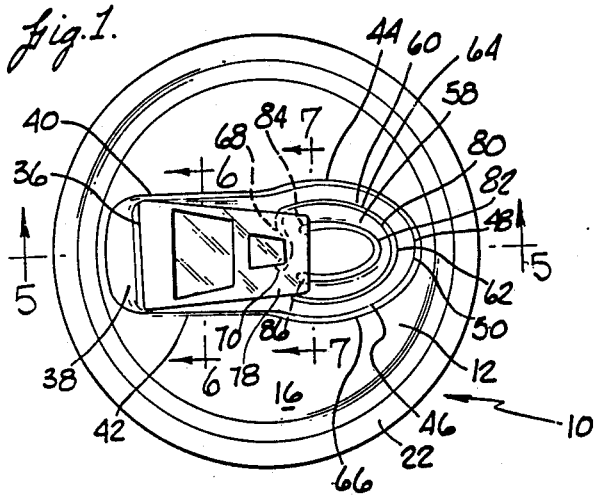
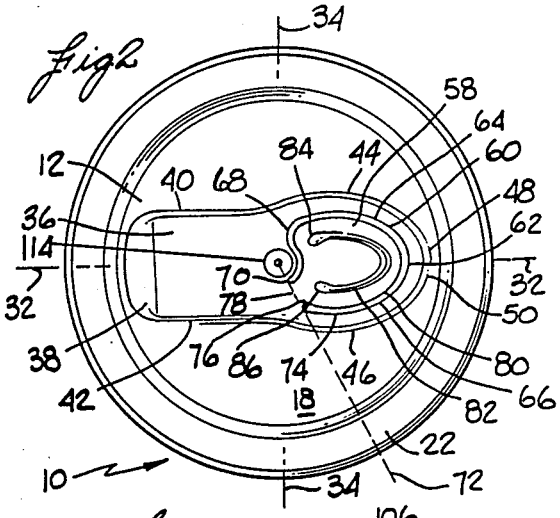
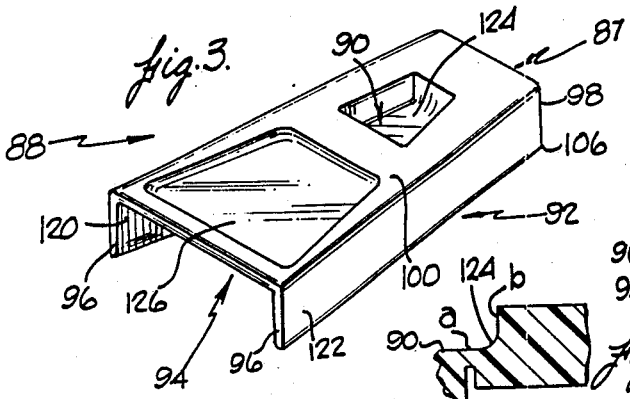
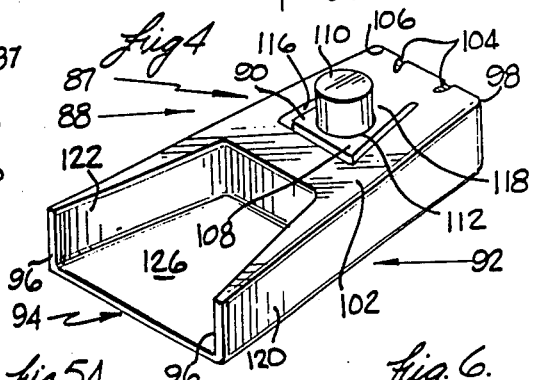
Fig.5A
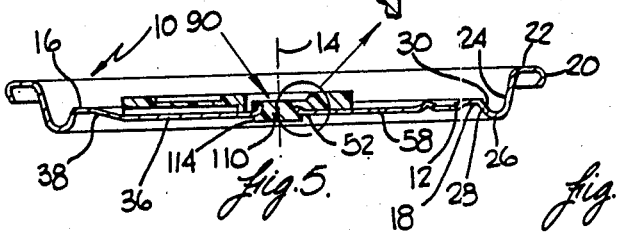
Fig.5.
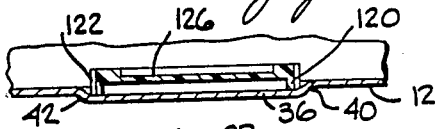
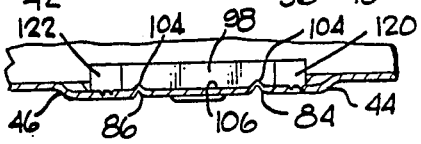
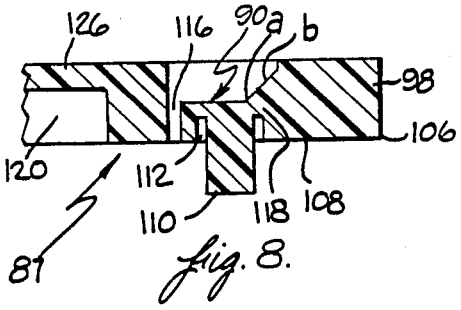
Fig. 8.
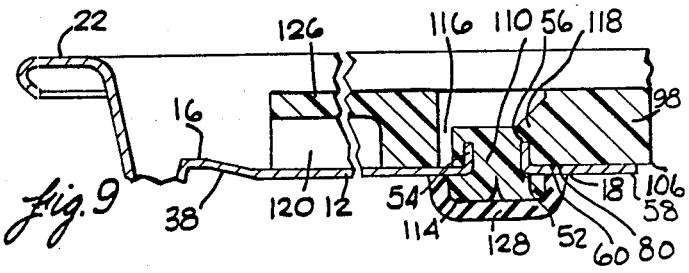
Fig.9
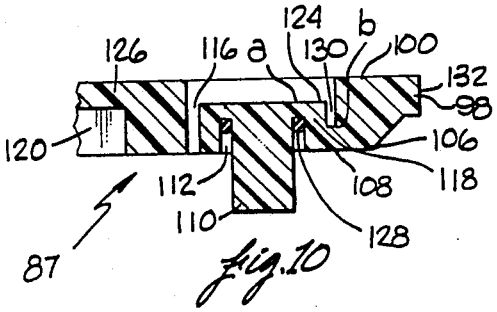
Fig.10
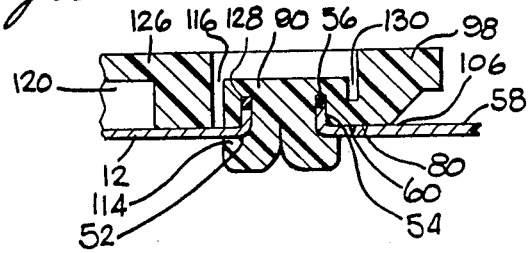

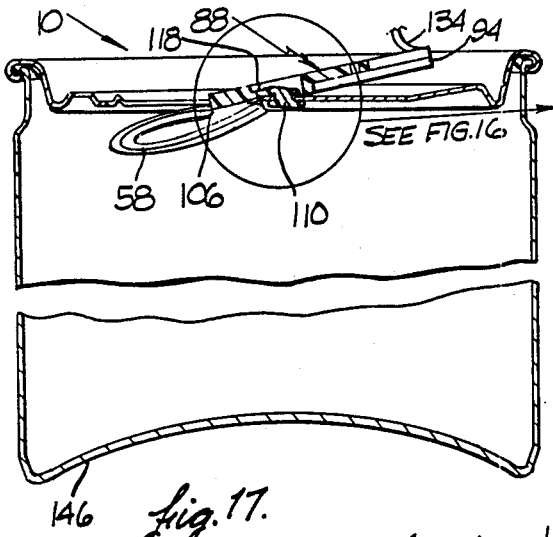
Fig. 17.
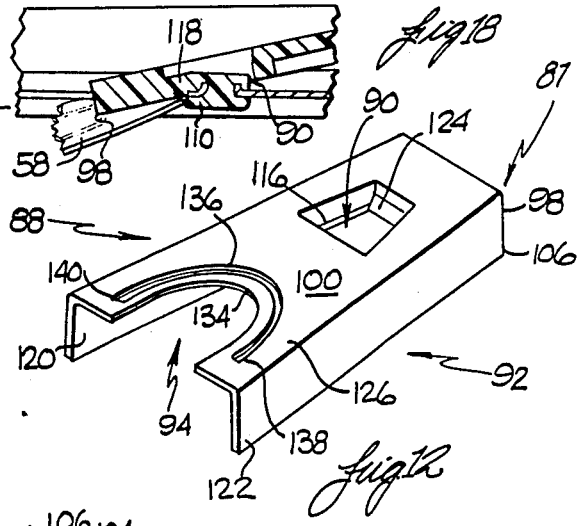
Fig. 18
Fig. 12
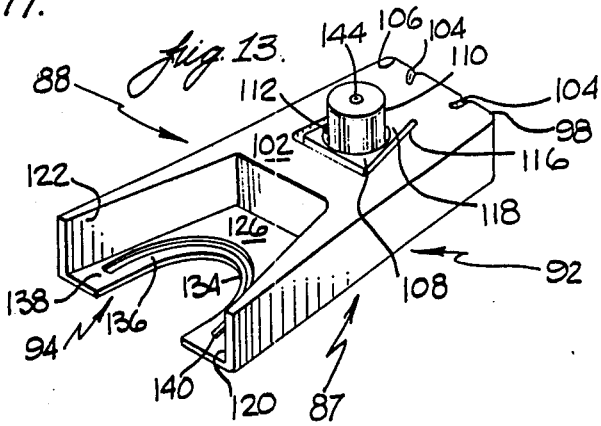
Fig. 13.
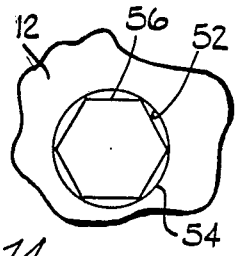
Fig. 16.
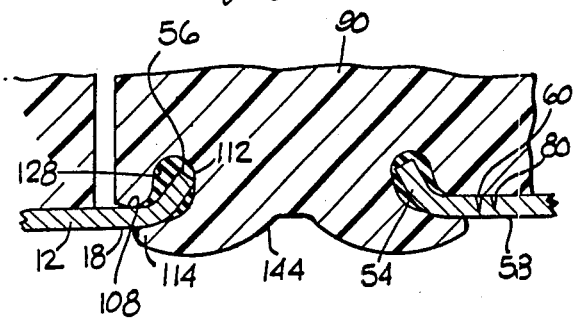
Fig. 15.
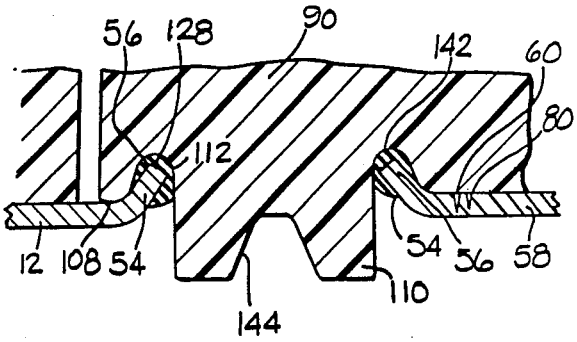
Fig. 14.

Fig. 19.
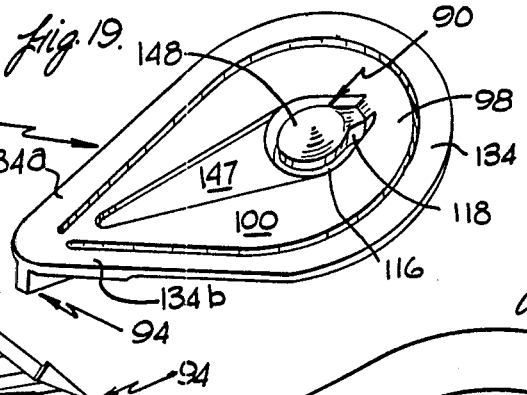
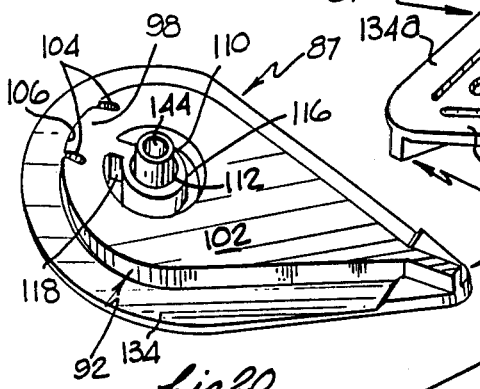
Fig. 20.
Fig. 21.
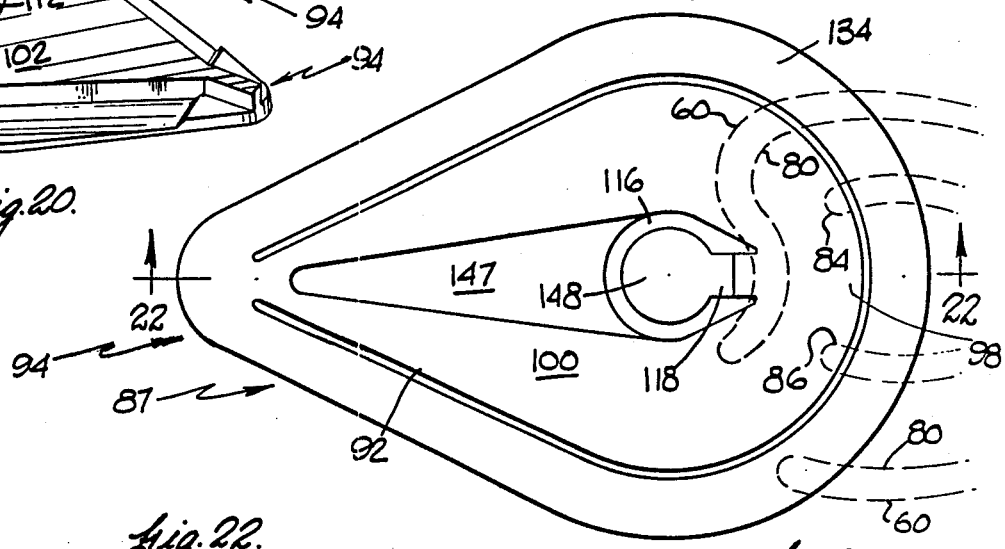
Fig. 22.
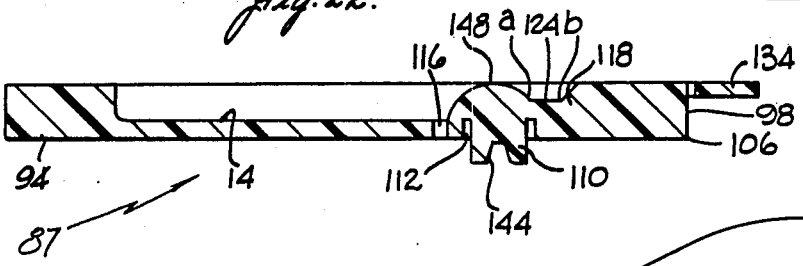
Fig. 22A
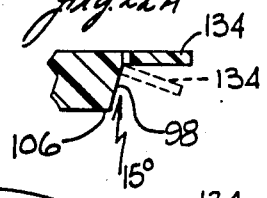
Fig. 23.
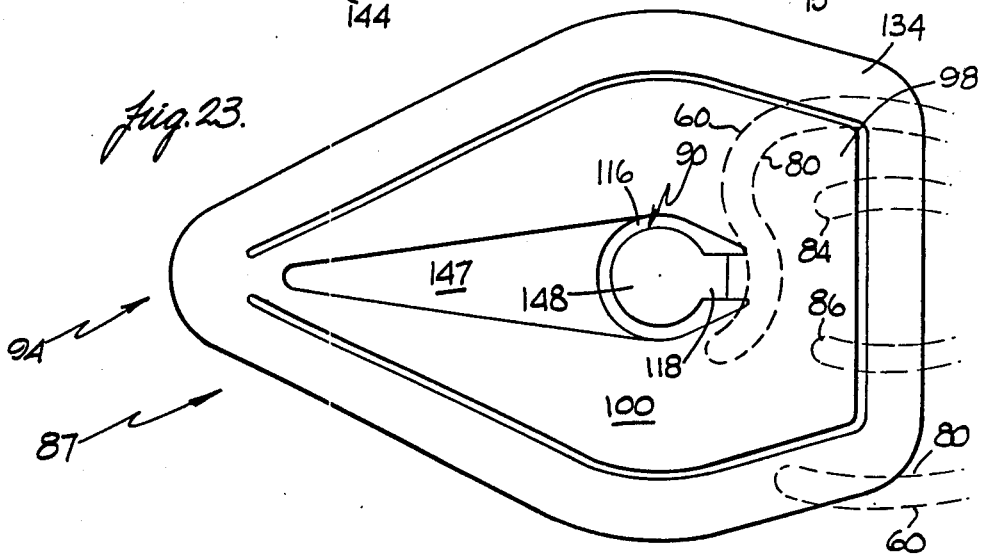

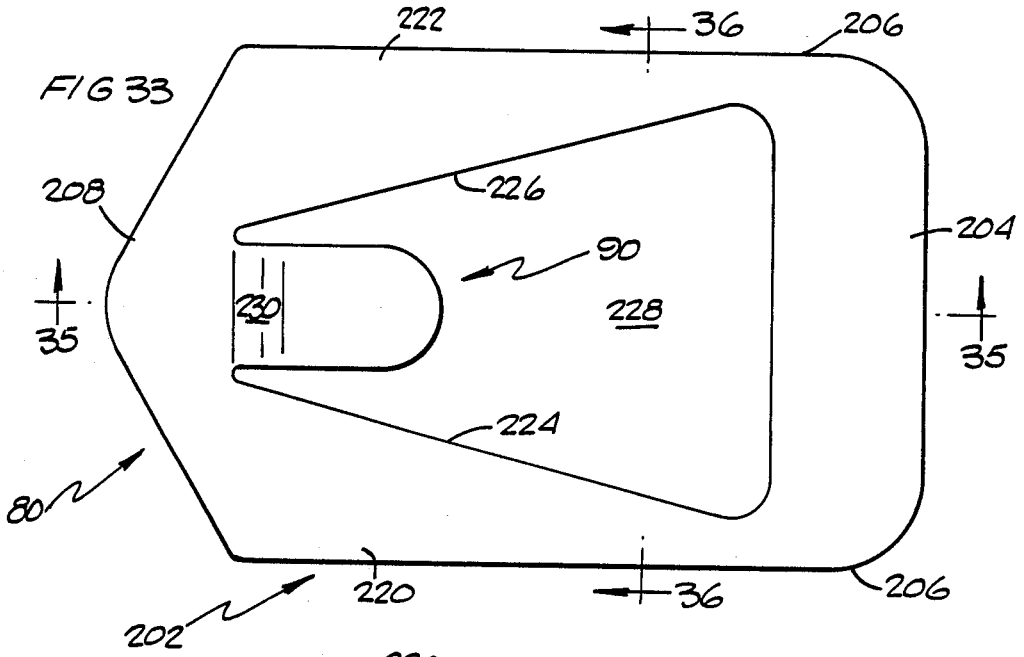
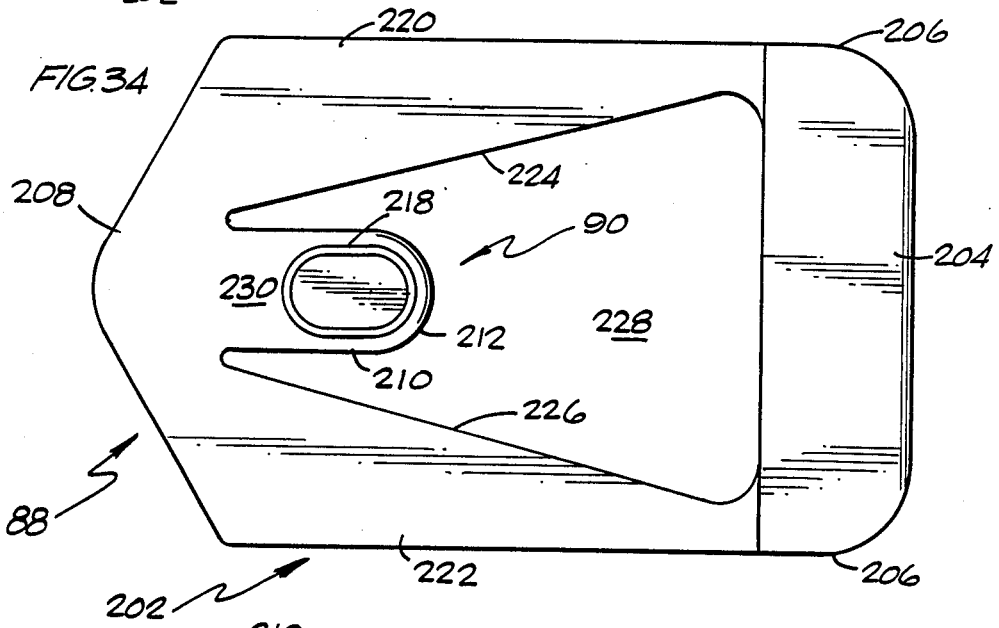
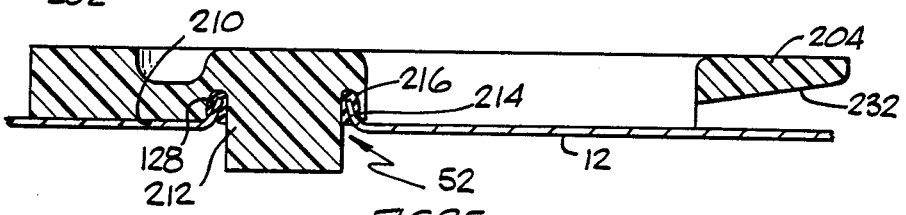
FIG. 35
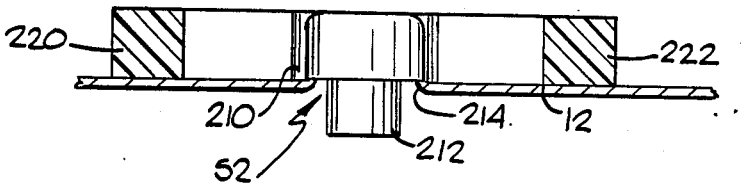
FIG. 36

SYSTEM FOR FORMING AN OPENING IN A CONTAINER END MEMBER

This application is a continuation-in-part of application Ser. No. 45,369 filed May 1, 1987; now U.S. Pat. No. 4,733,793.

FIELD OF THE INVENTION

This invention relates generally to a system for forming an opening in the end member of a beverage container so that the beverage therein may be readily removed therefrom and more particularly to an ecology type of beverage container end member wherein a tab means which is displaced to form the opening remains permanently secured to the container end member after the opening has been formed and more specifically to such an ecology type of container end member wherein a portion of the system for forming an opening in the beverage container end member includes a plastic tab.

BACKGROUND OF THE INVENTION

In the commercial marketing of beverages, such as beer and soft drinks, it is highly desirable to market such beverages in a manner to enhance consumer acceptance. One of the more common methods of marketing beverages is in containers, such as two piece aluminum or steel cans, which are provided with easy opening tab means of some nature. One such type of easy opening tab means is known as a ring pull type opening means wherein a closed score line is provided in a can end member and a pull tab is secured to the can end member within the boundary defined by the score line by suitable means such as a rivet. In operation, a force is applied to the tab so as to rupture a portion of the score line. Force is continued to be applied and the tab portion of the can end member within the score line is completely separated from the can lid along with the pull tab and rivet. The separated portions are then disposed of in a conventional manner.

Another type of easy opening tab device is known as the stay on tab (S.O.T.) wherein a non-closed score line is provided in a can end member and a force applying means is secured to the can end member at a location immediately outside a portion of the score line by suitable means such as a rivet. In this type of can end member, the force applying means is hingedly connected to the rivet. In operation, a force is applied to the force applying means and through the hinge association with the rivet, this force is applied to the scored tab portion of the can end member to break the score. The continued application of force pushes the scored portion down into the can. The non-closed portion of the score line retains the scored portion with the can end member and the force applying means remains attached by the rivet to remain with the can end member.

The type of container end members discussed above are usually formed from aluminum. In view of the costs associated with the making of aluminum, it is highly desirable to keep the tickness of the can end member to a minimum. Originally, the ring pull type opening means for can end members were manufactured with a rivet formed from the aluminum in the can end member serving to attach the force applying means to the scored tab portion to be removed. An alternative to this structure is found in U.S. Pat. No. 3,195,768 to Bozek and in U.S. Pat. No. 3,404,799 to McNamara wherein the ring force applying means is attached to the tab portion of the can end member within the score line by a plastic rivet integral with a ring force applying means. In spite of the savings to be obtained by making a can end member as thin as possible and the disclosures in Bozek, McNamara and other similar patents, it is still the present practice in making S.O.T. type openings for can end members to form the rivet from the aluminum in the can end member.

The aluminum S.O.T type tab means for aluminum containers are sometimes difficult to open completely. In addition, the force applying means may be separated from the container end member by simply flexing the force applying means several times, normally less than ten times, until it ruptures and is separated from the container end member. If the separated tab is thrown away, it presents an environmental or ecological problem.

BRIEF DESCRIPTION OF THE INVENTION

The present invention provides a new and improved stay-on type, easy opening tab means for a container end member comprising a severable tab portion formed in the central end wall portion of the container end member for downward opening movement about an integral hinge connection with the central end wall portion and a new and improved force applying means permanently attached to the central end wall portion for applying an opening force to the severable tab portion for the easy opening of the container.

In the preferred embodiment of the invention, the container end member is provided with severable score line groove means defining a severable tab portion that can be severed along the score line groove means by applying an inwardly directed force thereto and a hinge portion for retaining the severed tab portion attached to the container end member. A force applying means for applying the inwardly directed force to sever the severable tab portion is provided and comprises an integral plastic member having a elongated body portion having a central longitudinal axis and an integral attachment mean portion for securing the integral plastic member to the container end member. The elongated body portion has a generally transverse abutment end portion having a force applying edge portion overlying a generally minor portion of the severable tab portion and a transverse handle end portion. A pivot means portion integral with the attachment means portion and the elongated body portion provides for pivotal movement of the plastic member on the container end member so that when an axially outwardly directed force is applied to the generally transverse handle end portion, the elongated body portion will pivot about the pivot means portion so that the force applying edge portion will apply the inwardly directed force to the minor portion of the severable tab portion to sever the severable tab portion along the severable score line groove means and form an outlet opening in the container end member. The forces applied to the pivot means portion are distributed over a relatively large area so that the plastic member may be flexed several hundred times, such as three to four hundred times, without rupturing at the pivot means portion or any other portion to remain attached to the container end member.

The force applying means is attached to a container end member in the following manner. A generally central mounting hole means is formed in the container end member and has an outwardly projecting annular flange portion terminating in an edge portion. The attachment means portion of the plastic member has a connecting shaft means projecting from a flat lower surface thereof and is adapted to be inserted through the generally central mounting hole means in the container end member and extend downwardly therefrom. An annular recess in the flat lower surface of the attachment means portion surrounds a portion of the connecting shaft means. A layer of adhesive sealant material is located in the annular recess. The plastic member is secured to the container end member by inserting the connecting shaft means through the generally central mounting hole means until the edge portion of the projecting flange portion moves into contact with the layer of adhesive sealant material in the annular recess. Force is applied to deform the end of the connecting shaft means so that the portion of the container end member circumjacent the mounting hole means is secured between the flat lower surface of the attachment means portion and the deformed portion of the connecting shaft means. The layer of adhesive is in sealing engagement with the projecting annular flange and edge portions and the surfaces of the annular recess. This connection of the plastic member to the container end member permits the thickness of the container end member to be held to a minimum. In fact, a container end member of this invention can be safely held to a minimum of at least twenty percent less than the present minimum thickness of a container end member.

BRIEF DESCRIPTION OF THE DRAWINGS

Illustrative embodiments of the invention, including the presently preferred embodiment, are shown on the accompanying drawings in which:

FIG. 1 is a top plan view of a container end member incorporating one embodiment;

FIG. 2 is a bottom plan view of FIG. 1;

FIG. 3 is a pictorial view of a force applying means when supported on its lower surface;

FIG. 4 is a pictorial view of the force applying means of FIG. 3 when supported on its upper surface;

FIG. 5 is a cross-sectional view taken along line 5—5 of FIG. 1;

FIG. 5A is an enlarged view of a portion of FIG. 5;

FIG. 6 is a cross-sectional view taken along line 6—6 of FIG. 1;

FIG. 7 is a cross-sectional view taken along line 7—7 of FIG. 1;

FIG. 8 is a cross-sectional view, taken on a line similar to line 5—5 of FIG. 1, of a portion of another force applying means;

FIG. 9 is a cross-sectional view of a portion of a container end member with the force applying means of FIG. 8 secured thereto;

FIG. 10 is a cross-sectional view, taken on a line similar to line 5—5 of FIG. 1, of a portion of another force applying means;

FIG. 11 is a cross-sectional view of a portion of a container end member with the force applying means of FIG. 10 secured thereto;

FIG. 12 is a pictorial view of another force applying means when supported on its lower surface;

FIG. 13 is a pictorial view of the force applying means of FIG. 12 when supported on its upper surface;

FIG. 14 is an enlarged cross-sectional view of a portion of a container end member and a portion of a force applying means before the connecting shaft means thereof has been deformed;

FIG. 15 is a cross-sectional view similar to FIG. 14 after the force applying means has been secured to the container end member;

FIG. 16 is a bottom plan view of a portion of a container end member illustrating the shape of the mounting hole means;

FIG. 17 is a view in cross-section illustrating a partially opened container end member on a container;

FIG. 18 is an enlargement of a portion of FIG. 17;

FIG. 19 is a pictorial view of another embodiment of the force applying means when supported on its lower surface;

FIG. 20 is a pictorial view of the force applying means of FIG. 19 when supported on its upper surface;

FIG. 21 is a top plan view of FIG. 19 with a partial illustration of the score lines;

FIG. 22 is a cross-sectional view taken on the line 22—22 of FIG. 21;

FIG. 22A is a modification of a portion of FIG. 22;

FIG. 23 is a top plan view of another force applying means;

FIG. 33 is a top plan view of the presently preferred embodiment of the force applying means;

FIG. 34 is a bottom plan view of FIG. 33;

FIG. 35 is a cross-sectional view taken on the line 35—35 of FIG. 33 with a portion of the container end member added; and FIG. 36 is a cross-sectional view taken on the line 36—36 of FIG. 33 with a portion of the container end member added.

DETAILED DESCRIPTION OF THE INVENTION

Figure 24:
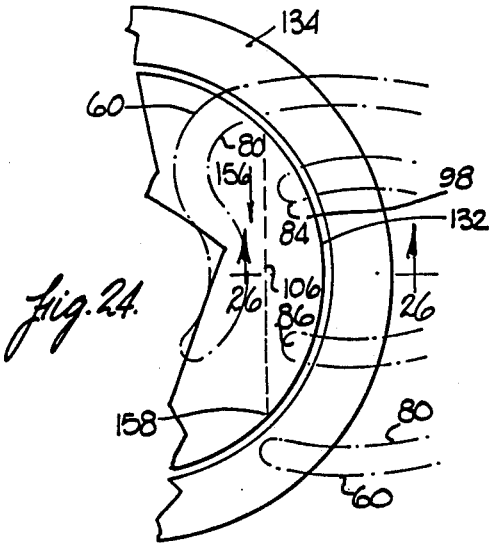
FIG. 24 is a top plan view of a portion of another force applying means.

In FIGS. 1, 2 and 5, there is illustrated a container end member 10, formed from a blank of sheet material such as, for example, an aluminum alloy of approximately 0.0080 inch in thickness, having a central end wall portion 12 and a central axis 14, to provide an outer surface 16 and an inner surface 18 when the container end member 10 is used in association with a container. In the embodiments of this invention, the central end wall portion 12 is axially inwardly off-set from an annular exterior rim portion 20 having an axially outwardly facing end surface 22 and integrally connected thereto by a generally radially inwardly extending flange portion 24, a rounded interior rim portion 26 located axially inwardly beyond the central end wall portion 12 and a generally radially inward slightly axially extending inclined flange portion 28 defining an annular axially outwardly opening groove 30 between the flange portion 24 and the central end wall portion 12. The central end wall portion has a diameter of between about 2.0 and 2.4 inches and preferably about 2.2 inches. While there are certain advantages in the aforedescribed arrangements of the preferred embodiment, it is to be understood that the central end wall portion 12 may be variously connected to the annular rim portion 20 by any suitable connecting flange portion structure.

As illustrated in FIG. 2, the container end member 10 has a first diametrical reference line 32 extending generally in the same direction as the cross-sectional line 5—5 of FIG. 1 and a second diametrical reference line 34 extending transverse thereto. A generally rectangularly shaped, axially inwardly depressed panel portion 36 is formed in the central end wall portion 12 and extends downwardly in an axially inward direction from the central end wall portion 12. The depressed panel portion 36 has an flat inclined outer end portion 38, two spaced apart generally parallel elongated axially inwardly inclined side edge portions 40 and 42, and two spaced apart curved, axially inwardly inclined edge portions 44 and 46 having central end portions 48 and 50 which meet at a point on the first diametrical reference line 32. The longitudinal axis of the depressed panel portion 36 extends in the same direction as the first diametrical reference line 32.

A central mounting hole mean 52 is formed at the intersection of the first and second diametrical reference lines 32 and 34 with the axis of the central mounting hole means 52 being coaxial with the central axis 14. As illustrated in FIGS. 9, 11, 14 and 15, the central mounting hole means 52 has an annular flange portion 54 terminating in an edge portion 56. As described below, the size and shape of the central mounting hole means 52, the annular flange portion 54 and the edge portion 56 can be varied as desired. A severable tab portion 58 is located generally between the curved, axially inwardly inclined edge portions 44 and 46. The configuration of the severable tab portion 58 is defined by an outer score line groove means 60 in the outer surface 16 of the depressed panel portion 36. The outer score line groove means 60 has a curved end portion 62 extending across the first diametrical reference line 32 and located adjacent to the end portions 48 and 50 of the depressed panel portion 36, a pair of spaced curved side portions 64 and 66 on opposite sides of the first diametrical reference line 32. The curved side portion 64 has a terminal end portion 68 extending across the first diametrical reference line 32 and located a relatively small distance from a portion of the periphery of the central mounting hole means 52 and having a terminal end 70 preferably located on a radial reference line 72 extending from the central axis of the mounting hole means 52 and laterally spaced in offset relationship with the first and second diametrical reference lines 32 and 34. The acute angle between the diametrical reference line 32 and the radial reference line 72 is about 63 degrees. The curved side portion 66 has a terminal end portion 74 having a terminal end 76 preferably located on the radial reference line 72 in radially outwardly spaced relationship to the terminal end 70. An integral hinge portion 78 extends along the radial reference line 72 between the terminal end 70 and the terminal end 76. An inner score line groove means 80, which is an insurance score line groove, has a configuration slightly smaller than the outer score line groove means 60. Also, the depth of the inner score line grove means 80 is less than the depth of the outer score line groove means 60. The depth of the score line groove is expressed by the score residual, which is the material remaining, and for score line groove means 60 the score residual is between about 0.0026 and 0.0036 inch and for score line groove means 80, the score residual is between about 0.0066 and 0.0076 inch. An open ended reinforcing rib 82 extends in an axially outward direction from the severable tab portion 58 and has a configuration similar to a portion of but slightly smaller than the inner score line groove means 80. The reinforcing rib 82 has spaced apart terminal end portions 84 and 86 located on opposite sides of the first diametrical reference line 32.

In the embodiment of FIGS. 1 and 2, the distance between the intersection of the outer score line groove 60 and the first diametrical reference line 32 and the central axis 14 is between about 0.07 and 0.15 inches and preferably about 0.085, the distance between terminal end portions 84 and 86 is between about 0.15 and 0.22 inches and preferably about 0.20 inches, the distance between the intersection of a line tangent to the terminal end portions 84 and 86 with the first diametrical reference line 32 and the central axis 14 is between about 0.20 and 0.30 inches and preferably about 0.23 inches and the portion of outer score line groove 60 concentric and adjacent to the center mounting hole means 52 is spaced a distance from the outer periphery of the annular flange portion 54 of between about 0.020 and 0.050 inch and preferably about 0.030 inch.

One embodiment of a force applying means 87 of this invention to apply the axially inwardly directed force to move the severable tab portion 58 to form the opening in the container end member 10 is illustrated in FIGS. 3 and 4 and comprises an integral plastic member 88 which is preferably formed by a cold forging or molding process wherein a slug of the plastic material, preferably a polyethylene terephthalate (P.E.T.), is subjected to forging or molding forces. When mounted on the container end member 10, the integral plastic member 88 has a attachment means portion 90 for securing the integral plastic member 88 to the central end wall portion 12, as described below. The integral plastic member 88 has an elongated body portion 92 having a longitudinal axis generally parallel to and spaced from the first diametrical reference line 32, a transverse handle portion 94 having spaced apart end surface portions 96 each located in radially inwardly spaced relationship to a part of the rim portion 20 and a transverse abutment end portion 98 located across the first diametrical reference line 32 at a location spaced radially outwardly from a line extending from terminal end portion 84 to terminal end portion 86. The normally horizontal configuration of the longitudinal extent of the elongated body portion 92, as illustrated in FIG. 1, is generally trapezoidal with the transverse handle portion 94 having the greater extent and the elongated body portion 92 has an upper surface 100 and a lower surface 102. A pair of spaced apart curved grooves 104 are formed in the lower surface 102 of the abutment end portion 98 and are located and shaped so that when the integral plastic member 88 is in position on the central end wall portion 12, the end portions 84 and 86 are located in the spaced apart curved grooves 104, as illustrated in FIG. 7, so that the force applying edge portion 106 of the abutment end portion 98 is in close proximity to the surface of the severable tab portion 58.

In the embodiment of FIG. 1, the integral plastic member 88 has an overall length along the longitudinal axis of between about 1.0 and 1.2 inches and preferably about 1.09 inch, a width at the abutment end portion 98 of between about 0.45 and 0.55 inch and preferably about 0.50 inch, a width at the transverse handle portion 94 of between about 0.65 and 0.75 inch and preferably about 0.68 inch and the top surface 100, when positioned on a central end wall portion 12, is between about 0.06 and 0.09 inch above the outer surface 16 of the central end wall portion 12 and preferably about 0.08 inch. The distance between the outer surface 16 of the panel portion 36 and the lower surface of the web 126 is between about 0.04 and 0.07 inch and preferably about 0.06 inch. The force applying edge portion 106 is perpendicular to the first diametrical reference line 32 and is spaced a distance from the central axis 14 along such line of between about 0.250 and 0.400 inch and preferably about 0.310 inch.

The attachment means portion 90 has a generally flat lower surface 108 facing the central end wall portion 12 and a connecting shaft means 110 extending axially inwardly therefrom and, when positioned on a central end wall portion 12, extends through the central mounting hole means 52. An annular recess 112 is formed in the flat lower surface 108 and surrounds the connecting shaft means 110. As illustrated in FIGS. 5, 9, 11, 15 and 18, when the connecting shaft 110 has been deformed, the portions of the central end wall portion 12 circumjacent the central mounting hole means 52 are fixedly secured between the flat lower surface 108 and the deformed connecting shaft means 114. A slot 116 is formed in the elongated body portion 92 so that the attachment means portion 90 is partially separated from the elongated body portion 92. The slot 116 also forms a pivot means portion 118, integral with both the attachment means portion 90 and the elongated body portion 92, to allow for pivotal movement of the elongated body portion 92 relative to the attachment means portion 90. The flat lower surface 108 extends between the boundaries of the slot 116 and is planar with the adjacent portions of lower surface 102 of the elongated body portion 92, as illustrated in FIG. 4, and also functions as a flat lower surface for the pivot means portion 118. In FIG. 5A, the pivot means portion 118 extends approximately between the locations a and b. The outer suface 124 of the pivot means portion 118 is joined to the elongated body portion 92 by a radius. The shape of the pivot means portion 118 in this and the other embodiments of the invention distribute the forces applied thereto over a relatively large area so that the handle portion may be flexed several hundred time, such as three to four hundred times, between a fully opened and a fully closed position without separation thereof from the central wall portion.

The transverse handle portion 94 comprises a pair of spaced apart side wall portions 120 and 122 of the elongated body portion 92 joined by an integral web 126 forming a part of the upper surface 100 of the elongated body portion 92 so that the web portion 126 is spaced above the depressed panel portion 36. This provides a space so that the tip of a finger of an user may be placed under the web portion 126 to apply an axially outwardly directed force thereto when forming the opening in the central end wall portion 12 as described below. In all embodiments of the invention, the forces applied to the pivot means portion 118 are distributed over a relatively large area so that the handle portion 94 may be flexed several hundred times, at least more than one hundred times, between a fully closed position closely adjacent to the central end wall portion 12 and a fully open position at the end of its pivotal movement in response to the axially outwardly directed force without rupturing of the pivot means portion 118 or any other portion so that the force applying means 87 will remain secured to the central end wall portion 12.

The embodiment of the force applying means illustrated in FIG. 8 is substantially the same as that illustrated in FIG. 5 with the pivot means portion 118 extending approximately between the locations a and b except that the outer surface 124 is joined to the elongated body portion 92 by a surface that is linear and inclined.

In FIG. 9, there is illustrated the force applying means 87 of FIG. 8 secured to the central end wall portion 12 of a container end member 10. The connecting shaft 110 has been deformed so that the surrounding portions of the central end wall portion 12 circumjacent the central mounting hole means 52 are secured between the deformed connecting shaft means 114 and the flat lower surface 108 and the annular flange portion 54 and the edge portion 56 are completely encased and in sealed relationship thereto. A small amount of adhesive sealant material 128 is placed over the deformed connecting shaft means 114 and has a continuous portion thereof in contact with the adjacent portion of the inner surface 18 of the central end wall portion 12.

The embodiment of the force applying means 87 illustrated in FIG. 10 has a pivot means portion 118 extending approximately between locations a and b and the outer surface 124 is flat except for a transversely extending linear recess 130 formed therein where it is joined to the elongated body portion 92. Also, the force applying edge portion 106 is located radially inwardly from the outer vertically extending surface 132 of the abutment end portion 98 and functions to reduce the amount of the axially outwardly directed force required to form the opening in the central end wall portion 12 of the container end member 10 as explained below in relation to FIGS. 24–32. The force applying edge portion 106 is perpendicular to the first diametrical reference line 32 and is spaced a distance from the central axis 14 along such line of between about 0.20 and 0.30 inch and preferably about 0.26 inch. The other dimensions correspond to those of FIG. 1. A quantity of adhesive sealant material 128 is positioned in the annular recess 112.

In FIG. 11, there is illustrated the force applying means of FIG. 10 secured to the central end wall portion 12 of a container end member 10. The connecting shaft means 110 has been deformed so that the surrounding portions of the central end wall portion 12 circumjacent the central mounting hole means 52 are secured between the deformed connecting shaft means 114 and the flat lower surface 108 and the annular flange portion 54 and the edge portion 56 are completely encased and in sealed relationship thereto. To ensure a complete seal, the edge portion 56 is embedded in the adhesive sealant material 128.

Another embodiment of the force applying means 87 is illustrated in FIGS. 12 and 13. Where possible, the parts of the force applying means 87 similar to corresponding parts described above have been given the same corresponding reference numbers. The transverse handle portion 94 in this embodiment is formed as a pull strip 134 formed by a cut-out in the web portion 126 and separated from the web portion 126 by a generally U-shaped slot 136 which terminates at end portions 138 and 140 so that the pull strip 134 is integral with the web portion 126.

A modification of the connecting shaft means 110 is particularly illustrated in FIGS. 14 and 15 wherein the connecting shaft means 110 is formed with a conical recess 144 to facilitate the deformation thereof. In FIG. 14, the annular flange portion 54 and the edge portion 56 are embedded in the adhesive sealant material 128 which has been placed in the annular recess 112. In FIG. 15, the connecting shaft means 110 has been deformed so that the edge portion 56 and a substantial portion of the annular flange portion 54 are completely encased by and in sealing engagement with the adhesive sealant material 128 which is also in sealing engagement with the adjacent surfaces of the annular recess 112. The surrounding portions of the central end wall portion 12 circumjacent the central mounting hole means 52 are secured between the deformed connecting shaft means 114 and the flat lower surface 108. However, the deformed connecting shaft means 114 does not cover any portion of the severable score line groove means 60 and 80.

As illustrated in FIGS. 8, 10 and 13–15, the size and shape of the connecting shaft means 110 can be varied as desired. For example, the connecting shaft means in FIG. 10 has a length, distance from the flat lower surfaoe 108, of about 0.09 inch and a diameter of about 0.188 inch while in FIG. 14, the length is about 0.07 inch and the diameter is about 0.125. Also, the depth of the recess 112 is shaped as desired to accommodate different annular flange portions 54.

As illustrated in FIGS. 10, 11, 14 and 15, it is preferable to use an adhesive sealant material 128 in the annular recess 112. However, in some instances, such as the structure illustrated in FIGS. 8 and 9, a satisfactory seal can be accomplished without the small amount of adhesive sealant material 128. In any event, it is desirable to provide suitable means for preventing relative rotation between the deformed connecting shaft means 114 and the annular flange portion 54. One such means is illustrated in FIG. 16 and comprises forming the annular flange portion 54 so that it changes shape so that the edge portion 56 has a polygonal cross-sectional inner surface configuration. In FIG. 16, the polygonal configuration is a hexagon but other shapes ma be used. When the connecting shaft 110 is deformed, suitable apparatus will be used so that the deformed connecting shaft means 114 will have an outer surface configuration corresponding to the inner surface configuration of the annular flange portion 54 and the edge portion 56.

As stated above, the size and shape of the central mounting hole means 52, the annular flange portion 54 and the edge portion 56 can be varied so as to cooperate with the connecting shaft means 110. In FIG. 16, the shortest distance betwee opposed sides of the hexagon is about 0.132 inch.

In operation, a plurality of container end members 10 having the configurations illustrated in the FIGS. 1, 2 and 5 are formed from an aluminum alloy in a conventional process. Also, a plurality of integral plastic members 88, formed as described above, are provided. A suitable adhesive sealant material 128, such as latex adhesive sealant marketed by Dewey and Almy under the trade designation DAREX 80, is deposited in each annular recess 112. The force applying means 87 is positioned on a central end wall portion 12 by inserting the connecting shaft means 110 through the central mounting hole mean 52 until the edge portion 56 is embedded in the adhesive sealant material 128. The connecting shaft means 110 is then deformed so that the edge portion 56 and a substantial portion of the annular flange portion 54 are completely encased by and in sealing engagement with the adhesive sealant material 128 which is also in sealing engagement with the adjacent surfaces of the annular recess 112. During the deforming operation, the portions of the central end wall portion 12 circumjacent the mounting hole means 52 are fixedly secured between the flat lower surface 108 and the deformed connecting shaft means 114. The thickness of the adhesive sealant material 128 in FIGS. 14 and 15 is exaggerated for illustration purposes only. The actual thickness of the adhesive sealant material is between about 0.002 and 0.010 inch and preferably about 0.005 inch. The deformed connecting shaft means 114 also conforms to the hexagonal shape of the annular flange portion 54 and the edge portion 56 so as to prevent accidental relative rotation between the deformed connecting shaft means 114 and the central end wall portion 12 so as to preserve the seal. As illustrated in FIGS. 5 and 9, the upper surface 100 of the integral plastic member 88 is below the level of the end surface 22 so that containers may be stacked one on top of another. As illustrated in FIG. 17, the container end member 10 is then secured to the open edge portion of a container 146 in a conventional manner.

When it is desired to form an opening in the container end member 10 using the force applying means of FIGS. 12 and 13, as illustrated in FIGS. 17 and 18, a user inserts the pip of a finger under the transverse handle portion 94 and applies an axially outwardly directed force to the web portion 134. The force is continued to be applied to the web portion 134 and is transmitted to the side wall portions 120 and 122 causing the elongated body portion 92 to pivot around the pivot means portion 118. Since the pivot means portion 118 is secured to the central end wall portion 12 by the integral deformed connecting shaft means 114, the pivotal movement of the elongated body portion 92 changes the axially outwardly directed force applied to the web portion 134 to an axially inwardly directed force which is applied by the force applying edge portion 106 to the severable tab portion 58 to sever the severable tab portion 58 along the outer score line groove means 60 so that the severable tab portion 58 moves axially inwardly into the container 146 to form an opening in the central end wall portion 12. The integral hinge means 78 functions to keep the severable tab portion 58 secured to the central end wall portion 12.

Another embodiment of the force applying means 87 is illustrated in FIGS. 19–22 in which the relative location of the outer and inner score line groove means 60 and 80 and the terminal end portions 84 and 86 are illustrated by the phantom lines in FIG. 21. Where possible, the parts of the force applying means 87 have been given the same corresponding reference numbers used above. The combined horizontal configuration of the elongated body portion 92, the handle portion 94 and the abutment end portion 98 is generally shaped as a tear drop with the abutment end portion 98 and the force applying edge portion 106 being an arc of a circle. The lower surface 102 is generally planar and has the curved grooves 104 formed therein. The upper surface 100 is provided with a recessed web portion 147. The thin pull strip 134 exends around and is spaced from the periphery of the elongated body portion 92 and the abutment portion 98 and has at least two end portions **134*a* and 134*b* integral with the handle portion 94. The attachment mean portion 90 has a spherical outer upper surface 148, an axially inwardly extending connecting shaft means 110, an annular recess 112 and a conical recess 144. A slot 116 partially separates the attachment means portion 90 from the elongated body portion 92 and also forms the pivot means portion 118 which is integral with both the attachment means portion 90 and the elongated body portion 92. The pivot means portion 118 extends approximately between the locations a and b (FIG. 22) and is joined to the elongated body portion 92** by a surface that is linear and inclined.

The embodiment of the invention illustrated in FIGS. 19–22 provides an easy method for operating the force applying means so as to apply the severing force to the severable tab portion to form the opening in the container end member. As illustrated in FIG. 22, the pull strip 134 is relatively thin as compared to the elongated body portion 92. The tip of a finger may be readily inserted under the portion of the pull strip 134 near the force applying edge portion 106 so that the pull strip 134 may be easily moved in an axially upward direction. The amount of force necessary to initiate the movement of the pull strip 134 in the axially upward direction is substantially nothing when compared to the amount of force necessary to initiate the movement of the presently marketed S.O.T. type of container ends. The tip of the finger may then be moved within the pull strip 134 for the continued application of force which is transmitted through the end portions 132*a* and 132*b* to the handle portion 94. The continued application of force to the pull strip 134 will cause the pivotal movement of the elongated body portion 92 so that the force applying edge portion 106 will apply the axially inwardly directed force on the severable tab portion 58 to form the opening in the container end member 10. The pull strip 134 closely conforms to the outer periphery of the elongated body member 92 so that it may be readily internally formed therewith in a forging or molding operation using a minimum amount of material. In a modification illustrated partially in FIG. 22A, the abutment end portion 98 extends at an angle, preferably about 15 degrees to the vertical, so that after the opening has been formed in the container end member, the pull strip 134 may be pushed axially downwardly and be retained in the dotted line position, illustrated in FIG. 22A, by the edge of the abutment end wall portion 98 so that it will not interfere with a person drinking the beverage from the container through the opening in the container end wall.

In FIGS. 19–22, the integral plastic member 88 has an overall length along the longitudinal axis thereof of between about 1.00 and 1.30 inches and preferably about 1.190 inches and the force applying edge portion 106 is an arc of a circle having the central axis 14 as its center and has a radius of between about 0.250 and 0.400 inch and preferably about 0.310 inch. When applied to a central end wall portion 12, the distance between the outer surface 16 of the panel portion 36 and the bottom surface of the thin pull strip 134 is between about 0.05 and 0.08 inch and preferably about 0.07 inch. The top surface 100 is between about 0.07 and 0.10 inch above the outer surface 16 and preferably about 0.085 inch.

Another embodiment of a force applying means 87 is illustrated in FIG. 23 and corresponds generally to that illustrated in FIGS. 19–22 except for the shape of the elongated body portion 92 and the abutment end portion 98 and the force applying edge portion 106 which extend in a linear direction. The cross-sectional configuration of the embodiment of FIG. 23 is the same as that illustrated in FIG. 22. The force applying edge portion 106 is perpendicular to the first diametrical reference line 32 and is spaced a distance from the central axis 14 along such line of between about 0.250 and 0.400 inch and preferably about 0.310 inch and extends for a distance of between about 0.300 and 0.600 inch and preferably about 0.460 inch. The other dimensions correspond to those of FIGS. 19–22.

Figure 25:
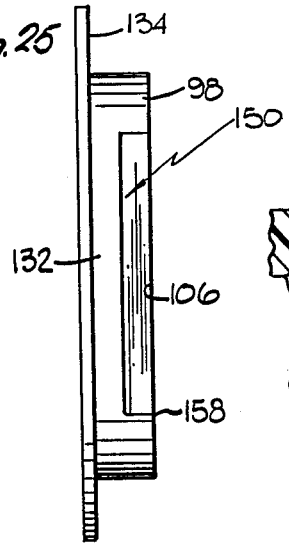
FIG. 25 is a front elevational view of FIG. 24.
Figure 26:
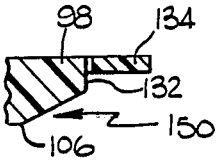
FIG. 26 is a cross-sectional view taken on the line 26—26 of FIG. 24.

In FIGS. 24–32, there are illustrated various configurations of the force applying edge portion 106 for the embodiments of FIGS. 21 and 23 for applying the inwardly directed force to the severable tab portion 58. In FIGS. 24–26, a portion 150 of the abutment end portion 98 has been removed so that the force applying edge 106 is spaced radially inwardly from the outer vertically extending surface 132 and is located between the ends of the terminal end portions 84 and 86 and a portion of the inner score line groove means 80. When a force is applied to the pull strip 134 and transmitted to the force applying edge portion 106, the force applied to the severable tab portion 58 will cause an initial severing of the outer score line groove means 60 at a location near the central mounting hole means 52. The continued application of force by the force applying edge portion 106 will move the contacting relationship between the force applying edge portion 106 and the severable tab portion 58 in the direction of the arrow 156 until the end 158 of the force applying edge portion 106 has been reached. The structure, as illustrated in FIGS. 24–26 and also FIGS. 10 and 11, permits the force applying edge portion 106 to be located closer to the attachment means portion 90 so as to increase the mechanical advantage obtained from the lever action of the elongated body 92 so that less force is needed to form the opening in the central end wall portion 12. The force applying edge portion 106 is perpendicular to the first diametrical reference line 32 and is spaced a distance from the central axis 14 along such line of between about 0.20 and 0.30 inch and preferably about 0.26 inch and extends for a distance of between about 0.300 and 0.500 inch and preferably about 0.460 inch. The other dimensions correspond to those of FIGS. 19–22.

Figure 27:
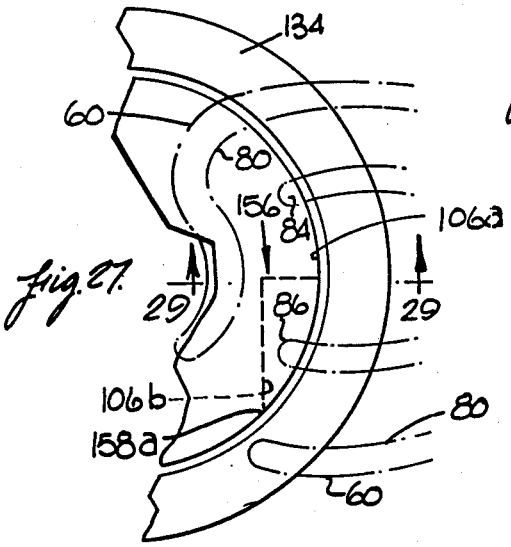
FIG. 27 is a top plan view of a portion of another force applying means.
Figure 28:
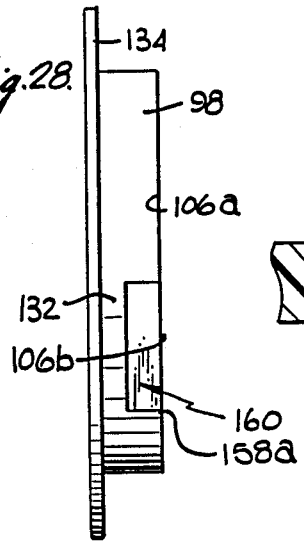
FIG. 28 is a front elevational view of FIG. 27.
Figure 29:
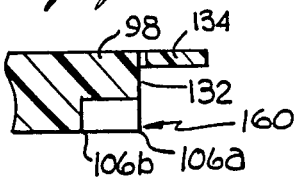
FIG. 29 is a cross-sectional view taken on the line 29—29 of FIG. 27.

In FIGS. 27–29, a smaller portion 160 of the abutment end portion 98 has been removed so that the force applying edge portion 106 has a first portion 106*a* and a second portion 106*b*. When a force is applied to the pull strip 134, it is transmitted first to the first portion 106*a* so that it can be concentrated in a smaller area so that the initial severing of the outer score line groove means 60 is more readily effected. The continued application of force by the first portion 106*a* will move the contacting relationship between the first portion 106*a* and the severable tab portion 58 in the direction of the arrow 156 until contacting relationship is established between the second portion 106*b* and the severable tab portion 58 which is then continued in the same direction until the end 158*a* of the second portion 106*b* has been reached. The first portion 106*a* is an arc of a circle having the central axis as its center and has a radius of between about 0.250 and 0.400 inch and preferably of about 0.310 inch. The second portion 106*b* is perpendicular to the first diametrical reference line 32 and is spaced a distance from the central axis 14 along such line of between about 0.20 and 0.30 inch and preferably about 0.26 inch. The edge between the first and second portions 106*a* and 106*b* is along the first diametrical reference line 32. The other dimensions correspond to those of FIGS. 19–21.

Figure 30:
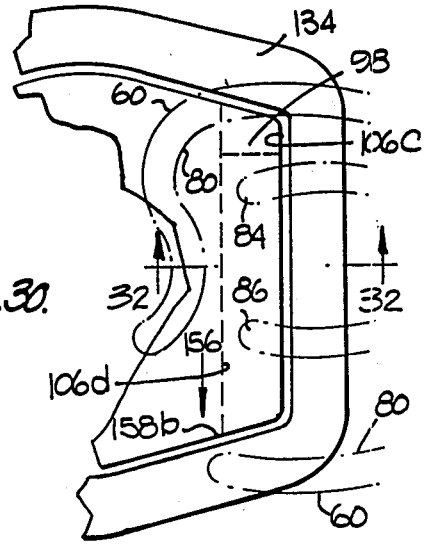
FIG. 30 is a top plan view of a portion of another force applying means.
Figure 31:
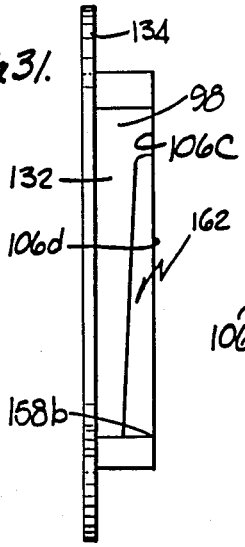
FIG. 31 is a front elevational view of FIG. 30.
Figure 32:
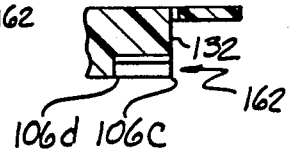
FIG. 32 is a cross-sectional view taken on the line 32—32 of FIG. 30.

In FIGS. 30–32, a portion of the abutment end portion 98 has been removed so that the force applying edge portion 106 has a first portion 106c and a second portion 106d.

When a force is applied to the pull strip 134, it is transmitted first to the first portion 106c so that it can be concentrated in a very small area so that the initial severing of the outer score line groove means 60 is readily effected. The continued application of force by the first portion 106c will move the contacting relationship between the first portion 106c and the severable tab portion 58 in the direction of the arrow 156 until contacting relationship is established between the second portion 106d and the severable tab portion 58 which is then continued in the same direction until the end 158b has been reached. The first portion 106c is perpendicular to the first diametrical reference line 32 and is spaced a distance from the central axis 14 along such line of between about 0.250 and 0.400 inch and preferably of about 0.310 inch and extends for a distance of between about 0.10 and 0.20 inch and preferably about 0.15 inch. The second portion 106d is perpendicular to the first diametrical reference line 32 and is spaced a distance from the central axis 14 along such line of between about 0.20 and 0.30 inch and preferably about 0.26 inch and extends for a distance of between about 0.30 and 0.40 inch and preferably about 0.35 inch. The other dimensions correspond to those of FIG. 23.

The presently preferred embodiment of the force applying means is illustrated in FIGS. 33–36. The integral plastic member 88 has an elongated body portion 202 having a longitudinal axis generally parallel to the first diametrical reference line 32, a transverse handle portion 204 having spaced apart end surface portions 206 each located in radially inwardly spaced relationship to a part of the rim portion 20 and a transverse abutment end portion 208 located across the first diametrical reference line 32 at a location spaced radially outwardly from a line extending from terminal end portion 84 to terminal end portion 86.

The attachment means portion 90 has a generally flat lower surface 210 facing the central end wall portion 12 and a connecting shaft means 212 extending axially inwardly therefrom and, when positioned on a central end wall portion 12, extends through the central mounting hole means 52 having a flange portion 214 terminating in an edge portion 216. A recess 218 is formed in the flat lower surface 210 and surrounds the connecting shaft means 212. As illustrated in FIG. 35, before the connecting shaft 212 has been deformed, adhesive sealant material 128 has been placed in the recess 218 and the flange portion 214 of the central mounting hole means 52 is embedded therein.

The elongated body portion 202 comprises two side wall portions 220 and 222, each having one end integral With the abutment end portion 208 and the other end thereof integral with the handle portion 204. The inner surfaces 224 and 226 are spaced from each other to form a central opening 228 and are also spaced from the attachment means 90. A pivot means portion 230 is integral with the attachment means portion 90 and the abutment end portion 208 to allow for pivotal movement of the elongated body portion 202 relative to the attachment means portion 90.

The transverse handle portion 204 has an inclined lower surface 232 that is spaced above the central end wall portion 12. This provides a space so that the tip of a finger of an user may be placed under the lower surface 232 to apply an axially outwardly directed force thereto when forming the opening in the central end wall portion 12 as described above. As with the other embodiments of the invention, the forces applied to the pivot means portion 230 are distributed over a relatively large area so that the handle portion 204 may be flexed several hundred times, at least more than one hundred times, between a fully closed position closely adjacent to the central end wall portion 12 and a fully open position at the end of its pivotal movement in response to the axially outwardly directed force without rupturing of the pivot means portion 230 or any other portion so that the force applying means 87 will remain secured to the central end wall portion 12.

When the connecting shaft means 212 has been deformed, it is similar to the embodiment illustrated in FIGS. 14 and 15 with the surrounding portions of the central end wall portion circumjacent the mounting hole means 52 secured between the deformed connecting shaft means 212 and the flat lower surface 210 of the attachment mean 90. As illustrated in FIG. 34, the connecting shaft means 212 has a cross-sectional configuration in the shape of an oval and as illustrated in FIGS. 35 and 36, the central mounting hole means 52, the flange portion 214 and the edge portion 216 have cross-sectional configurations in the shape of an oval for cooperation with the oval shaped connecting shaft means 212 to prevent relative rotation therebetween.

The integral plastic member 88 of FIGS. 33–36 is formed from a relatively rigid plastic material, preferably polyethylene terephthalate (P.E.T.). The integral plastic member 88 in FIGS. 33–36 has dimensions generally similar to the integral plastic member 88 illustrated in FIGS. 3 and 4.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A container end member or the like for sealed association with a container member to provide a sealed container and which is provided with a system for forming an opening therein comprising:

a one piece metallic end member having a cylindrical peripheral rim wall portion and a central axis;

an annular outer rim portion on said metallic end member for sealed association with the container member;

a central end wall portion integrally connected to said rim portion and extending generally transversely to said central axis and having an outer surface and an inner surface;

a severable tab portion in and integrally connected to said central end wall portion;

a hinge portion integral with said central end wall portion and having spaced apart ends;

severable score line groove means having ends adjacent to said spaced apart ends of said hinge portion and defining said severable tab portion so that said severable tab portion may be severed from said central wall portion in response to applied axially inwardly directed forces and form an outlet opening in said central end wall portion;

retaining means comprising said hinge portion for retaining said severed tab portion attached to said central end wall portion;

force applying means for applying said axially inwardly directed forces on said severable tab portion;

said force applying means comprising:

an integral plastic member formed from a relatively rigid plastic material;

an attachment means portion integral with said plastic member for securing said plastic member to said central end wall portion;

said plastic member having an elongated body portion having an abutment end portion at one end thereof and a handle portion at the other end thereof; and a pivot means portion integral with said attachment means portion and said elongated body portion for pivotally mounting said elongated body portion on said central end wall portion so that when an axially outwardly directed opening force is applied to said handle portion, said elongated body portion will pivot about said pivot means portion so that said abutment end portion will apply said inwardly directed force to said severable tab portion to sever said severable tab portion along said severable score line groove means and form said outlet opening in said central end wall portion.

2. A container end member or the like for sealed association with a container member to provide a sealed container and which is provided with a system for forming an opening therein comprising:

a one piece metallic end member having a cylindrical peripheral rim wall portion and a central axis;

an annular outer rim portion on said metallic end member for sealed association with the container member;

a central end wall portion integrally connected to said rim portion and extending generally transversely to said central axis and having an outer surface and an inner surface;

a severable tab portion in and integrally connected to said central end wall portion;

a hinge portion integral with said central end wall portion and having spaced apart ends;

severable score line groove means having ends adjacent to said spaced apart ends of said hinge portion and defining said severable tab portion so that said severable tab portion may be severed from said central wall portion in response to applied axially inwardly directed forces and form an outlet opening in said central end wall portion;

retaining means comprising said hinge portion for retaining said severed tab portion attached to said central end wall portion;

force applying means for applying said axially inwardly directed forces on said severable tab portion;

said force applying means comprising:

an integral plastic member formed from a relatively rigid plastic material;

an attachment means portion integral with said plastic member for securing said plastic member to said central end wall portion;

said plastic member having an elongated body portion having an abutment end portion at one end thereof and a handle portion at the other end thereof; and a pivot means portion integral with said attachment means portion and said elongated body portion for pivotally mounting said elongated body portion on said central end wall portion so that when an axially outwardly directed opening force is applied to said handle portion, said elongated body portion will pivot about said pivot means portion so that said abutment end portion will apply said inwardly directed force to said severable tab portion to sever said severable tab portion along said severable score line groove means and form said outlet opening in said central end wall portion;

a central mounting hole means formed in said central end wall portion;

said central mounting hole means having a continuous annular flange portion projecting axially outwardly from said outer surface and terminating in an edge portion for cooperation with said attachment means portion for securing said force applying means to said central end wall portion; and rotation preventing means for preventing relative rotation between said attachment means portion and said annular flange portion.

3. A container end member as in claim 2 wherein said rotation preventing means comprises:

said attachment means portion having at least a section thereof having a cross-sectional configuration in the shape of an oval; and said annular flange portion having a cross-sectional configuration in the shape of an oval for mating with said section of said attachment means portion.

4. A container end member as in claim 2 and further comprising:

said attachment means portion and said pivot means portion being separated from said elongated body portion by a slot so that said elongated body portion can be pivoted while said attachment means portion remains fixed to said central end wall portion; and said pivot means portion being shaped to distribute forces applied thereto over a relatively large area so that said handle portion can be flexed between a fully closed position and a fully opened position at least more than one hundred times without separation thereof from said central end wall portion.

5. A container end member as in claim 2 wherein said attachment means portion includes:

a generally flat lower surface facing said central end wall portion;

a connecting shaft means projecting axially inwardly from said flat lower surface;

a continuous surface defining an annular recess in said flat lower surface surrounding a portion of said connecting shaft means and adapted to receive said edge portion and at least a portion of said annular flange portion;

said connecting shaft means passing through said mounting hole means so that when said connecting shaft is deformed, said annular flange portion is encased between said deformed connecting shaft means and said flat lower surface; and the surrounding portions of said central end wall portion circumjacent said central mounting hole means are secured between said deformed connecting shaft mean and said flat lower surface.

6. A container end member as in claim 5 and further comprising:

sealing means in said annular recess adapted to be contacted by said edge portion to form a continuous seal between said edge portion and said continuous surface.

7. A container end member as in claim 6 wherein said rotation preventing means comprises:

said annular flange portion having a cross-sectional configuration in the shape of an oval; and said connecting shaft means having a cross-sectional configuration in the shape of an oval for mating with said annular flange portion.

8. A container end member as in claim 2 and further comprising:

said elongated body portion having a pair of spaced apart side wall portions, each having one end thereof integral with said abutment end portion; and each of said side wall portions having the other end thereof integral with said handle portion.

9. A container end member as defined in claim 8 and further comprising:

said handle portion located a distance above said upper surface of said central end wall portion to provide a space for a finger tip to apply said axially outwardly directed opening force on said handle portion.

10. A container end member as in claim 9 wherein said rotation preventing means comprises:

said attachment means portion having at least a section thereof having a cross-sectional configuration in the shape of an oval; and said annular flange portion having a cross-sectional configuration in the shape of an oval for mating with said section of said attachment means portion.

11. A container end member as in claim 10 and further comprising:

said attachment means portion and said pivot means portion being separated from said elongated body portion by a slot so that said elongated body portion can be pivoted while said attachment means portion remains fixed to said central end wall portion; and said pivot means portion being shaped to distribute forces applied thereto over a relatively large area so that said handle portion can be flexed between a fully closed position and a fully opened position at least more than one hundred times without separation thereof from said central end wall portion.

12. A container end member as in claim 11 wherein said attachment means portion includes:

a generally flat lower surface facing said central end wall portion;

a connecting shaft means projecting axially inwardly from said flat lower surface;

a continuous surface defining an annular recess in said flat lower surface surrounding a portion of said connecting shaft means and adapted to receive said edge portion and at least a portion of said annular flange portion;

said connecting shaft means passing through said mounting hole means so that when said connecting shaft is deformed, said annular flange portion is encased between said deformed connecting shaft means and said flat lower surface; and the surrounding portions of said central end wall portion circumjacent said central mounting hole mean are secured between said deformed connecting shaft means and said flat lower surface.

13. A container end member as in claim 12 and further comprising:

sealing means in said annular recess adapted to be contacted by said edge portion to form a continuous seal between said edge portion and said continuous surface.

14. A container end member as in claim 13 wherein: said relatively rigid plastic material comprises polyethylene terephthalate (P.E.T.).

15. A one-piece metallic end member having a cylindrical peripheral rim wall portion with a central axis and a pair of perpendicular transverse diametrical central reference lines extending through said central axis, a relatively thin central end wall portion having a generally flat outer surface and a generally flat inner surface, a mounting hole means having a center point located at the intersection of said central reference lines, a severable tab portion in said central wall portion and having a longitudinal axis extending along one of said central reference lines from a radially inwardly offset relationship to a first part of said peripheral rim wall portion toward said central axis and terminating in a radially outwardly spaced relationship to a portion of said mounting hole means, said severable tab portion having a central body portion defined by a continuous generally curved score line groove means having a curved end portion extending across said one of said central reference lines, a pair of spaced curved side portions located on opposite sides of said one of said central reference lines and extending toward said mounting hole means from said curved end portion, one of said spaced curved side portions having a terminal portion extending laterally across said one of said central reference lines between said mounting hole means and said central body portion and having a terminal end terminating on a radial reference line extending from the central axis of said mounting hole means and said terminal end being located in laterally spaced offset relationship to said one of said reference lines, the other of said spaced curved side portions having a terminal end terminating on said radial reference line in radially outwardly spaced relationship to said terminal end of said one of said spaced curved side portions, an integral hinge portion extending along said radial line between said terminal ends and means for applying an axially inwardly directed force on said severable tab portion comprising:

a force applying means for moving said severable tab portion to form said opening in said end member comprising a one-piece integrally formed plastic member for providing an opening in said end member by severing said severable tab portion along said score line groove means, said force applying means having an elongated body portion having a central longitudinal axis generally co-planar with said one of said reference lines, a transverse handle end portion located in radially inwardly spaced relationship to a second part of said peripheral rim wall portion and between said peripheral rim wall portion and said mounting hole means and having a portion thereof spaced from said upper surface of said central end wall portion, a transverse abutment end portion located in radially inwardly spaced relationship to said first part of said peripheral rim wall portion and between said hinge means and said curved end portion, an attachment means portion having a flat lower surface and a connecting shaft means extending downwardly therefrom through said mounting hole means and having a terminal end portion located below said central end wall portion of said end member and fixedly engaged with said inner surface of said central end wall portion circumjacent said mounting hole means and holding said flat lower surface of said attachment means portion in abutting engagement with said outer surface of said central end wall portion of said end member circumjacent said mounting hole means;

sealing means associated with said mounting hole means and said attachment means portion for preventing the passage of gases and liquids therebetween;

said transverse abutment end portion of said force applying means having a force applying edge portion extending transversely across and engageable with said central body portion of said severable tab portion between said pair of spaced curved side portions of said score line groove means for applying a severing force to said severable tab portion;

pivot means on said force applying means located between said transverse abutment end portion and said attachment means portion for enabling said handle end portion of said force applying means to be lifted axially upwardly away from said outer surface of said central end wall portion of said end member to cause axially inwardly pivotal movement of said abutment means against said central body portion of said severable tab portion to sever said severable tab portion from said central end wall portion of said end member along said score line groove means by axially inwardly pivotal movement about said hinge portion whereby said severable tab portion remains connected to said central end wall portion of said end member at said hinge portion and said force applying means remains attached to said central end wall portion of said end member by said attachment means portion; and rotation preventing means for preventing relative rotation between said attachment means portion and said mounting hole means.

16. The invention as in claim 15 wherein said rotation preventing means comprises:

said mounting hole means having a cross-sectional configuration in the shape of an oval; and said connecting shaft means having a cross-sectional configuration in the shape of an oval for mating with said mounting hole means.

* * * * *

UNITED STATES PATENT AND TRADEMARK OFFICE
Certificate

Patent No. 4,804,104 Patented: Feb. 14, 1989

On petition requesting issuance of a certificate for correction of inventorship pursuant to 35 USC 256, it has been found that the above-identified patent, through error and without any deceptive intent, improperly sets forth the inventorship.

Accordingly, it is hereby certified that the correct inventorship of this patent is: Bruce A. Moen and Jaroslav F. Pardubicky.

Signed and Sealed this Nineteenth Day of November 1991.

STEPHEN MARCUS

*Supervisory Patent Examiner*
*Patent Examining Art Unit 241*